United States Patent [19]

Badger

[11] 4,194,654

[45] Mar. 25, 1980

[54] BAG CARRIER

[76] Inventor: David H. Badger, 5883 N. Crestview Ave., Indianapolis, Ind. 46220

[21] Appl. No.: 914,730

[22] Filed: Jun. 12, 1978

[51] Int. Cl.[2] ..... B65D 71/00

[52] U.S. Cl. ..... 224/45 H; 248/97

[58] Field of Search ..... 224/45 P, 45 H, 47, 224/52 R, 52 B; 248/95, 97, 309 R; 108/33; 312/207, 211; 150/1, 12, 3

[56] References Cited

U.S. PATENT DOCUMENTS

| | | | |
|---|---|---|---|
| 2,900,123 | 8/1959 | Drnec et al. | 229/52 B |
| 3,167,212 | 1/1965 | Phillips, Jr. | 224/45 H |
| 3,346,167 | 10/1967 | Schmidt | 229/52 B |
| 3,664,622 | 5/1972 | Vaccaro | 248/95 |
| 3,687,408 | 9/1972 | Lake | 248/97 |

*Primary Examiner*—Kenneth W. Noland

[57] ABSTRACT

A carrier for a trash bag can be provided by a generally hollow structure, like a rectangular parallelepiped without a front or a top surface. The structure can be formed from material having elastic properties to permit the carrier to be deformed to engage the mouth of the trash bag and, upon elastic recovery, to hold the trash bag in the form of an open-mouthed container and support the bag and its contents in several useful positions. The structure can form a flap to permit the carrier to be more conveniently pulled from location to location and eliminate lifting and carrying of a filled or partially filled trash bag.

16 Claims, 6 Drawing Figures

Fig. 4
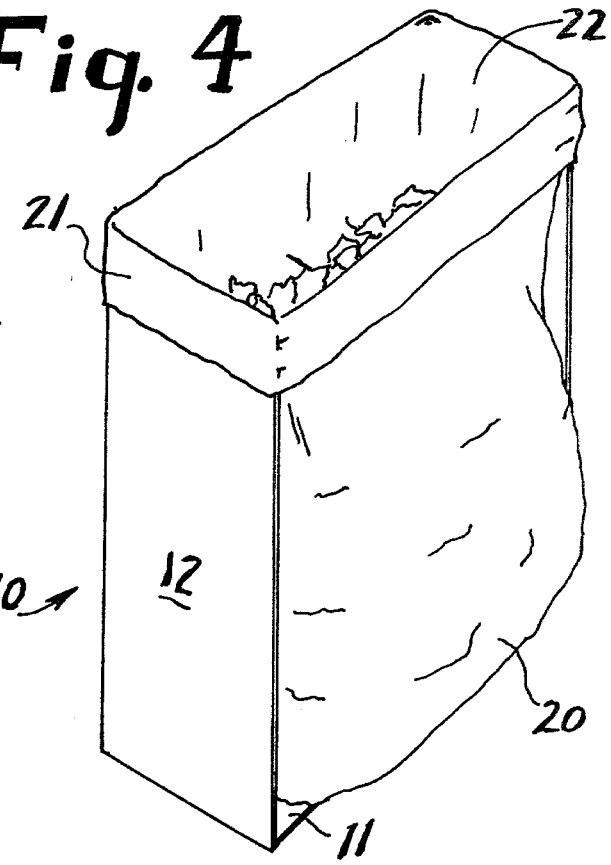
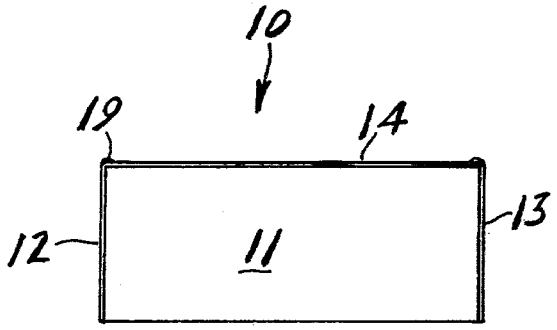
Fig. 3
Fig. 1
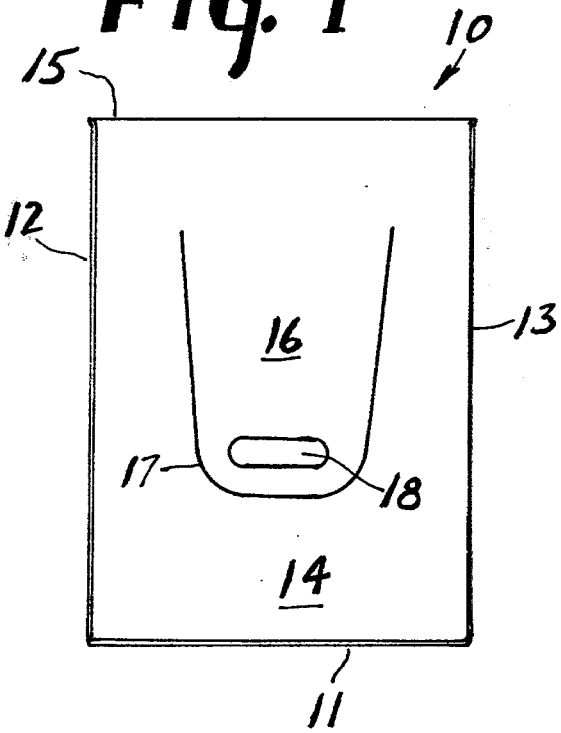
Fig. 2
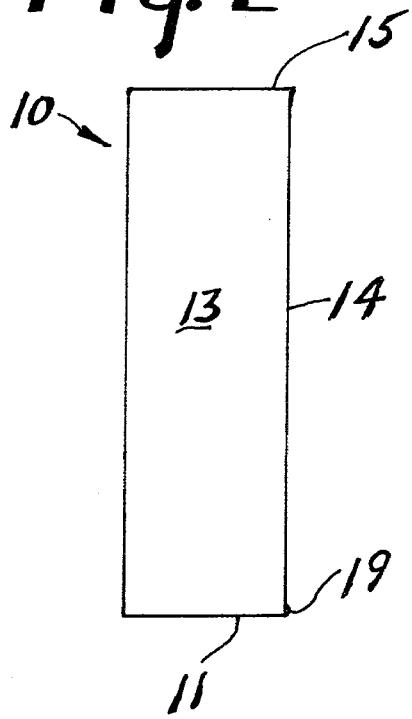

BAG CARRIER

This invention relates to a carrier for a trash bag which can be easily used in yard work. The bag carrier of this invention will provide support for a trash bag and its contents in each of several positions, permitting the bag and its contents to be shifted from position to position and providing an open-mounthed container in each position; will provide a means of conveniently transporting the bag and its contents from one location to another without the need of lifting and carrying the bag; will permit removal of the filled bag for disposal without lifting the bag and its contents; and will provide a structure that is durable and can be left out-of-doors without deterioration and that can be easily and inexpensively manufactured in one piece.

Such carriers are best made from material that has elastic properties and formed into a structure with walls that are a fraction of an inch thick. An average person can easily deform such a carrier and it will return to its original shape. Such materials are preferably moldable to form such a structure and include polymeric materials having elastic properties, such as the so-called plastic materials, like rigidized polyethylene, polypropylene, nylon and polystyrene, and natural and synthetic elastomeric materials like vulcanized rubber.

Supports for flexible bags have been disclosed in U.S. Pat. Nos. 3,426,958; 3,664,622; 3,687,408, and metallic supports have been disclosed in U.S. Pat. Nos. 3,095,172; 3,352,520; 3,598,350; 3,659,816, 3,893,615 and 3,905,406. Other older patents showing bagholders and supports include U.S. Pat. Nos. 1,604,905; 2,100,235; 2,314,490; 2,430,155; 2,456,862; 2,690,367; 2,695,129 and 2,759,695.

None of the above patents have disclosed a support having the advantages of the bag carrier of this invention. In accordance with the invention, a carrier for a trash bag is provided by means forming a generally hollow structure with walls to partially surround and hold a trash bag in the form of an open-mouthed container and support the bag and its contents in several positions. Such a structure can include an elastic top edge adapted to be deformed for engagement with the open end of the trash bag and upon elastic recovery to engage and hold the opening of the trash bag in an unobstructed opening. The carrier can be molded in one piece from a moldable material forming an elastic solid and can be formed from a single sheet of such elastic material. The structure of the carrier is preferably generally in the shape of a hollow rectangular parallelepiped without a front or a top surface. The back side can include a flap cut therein and having an opening adjacent its free end to be grasped as a handle with the top of the back side of the carrier remaining uncut to permit the carrier and bag to be pulled more conveniently from one location to another. Many moldable elastic materials exhibit a lubricous surface which permits a carrier made from such material to be more easily slid from location to location. To further assist such movements, runners may be molded into the base portion of the carrier, preferably at the edge between the back side and base of the carrier.

Such a carrier can provide substantial assistance, particularly in yard work. It can hold and support a trash bag in such a position that leaves and debris can easily be raked into its open mouth; it can also hold and support the filled or partially filled trash bag in an upright position so material can be dropped or shoveled into the bag; and it will support the trash bag and its contents as it is being reoriented between these positions. In addition, the carrier can serve as an inexpensive and durable stand to hold the trash bag as an open-mouthed container for the occasional addition of debris and trash. The filled or partially filled bag can be easily pulled from location to location and eliminate the need to lift and carry the filled or partially filled bag, and the filled trash bag can be removed from the carrier without lifting.

Furthermore, such a carrier can be easily and inexpensively manufactured in one piece by conventional molding techniques.

Further advantages and features will be apparent from the following description and from the drawings in which:

FIG. 1 is a view from the front of a carrier of this invention;

FIG. 2 is a view from the side of the carrier of FIG. 1;

FIG. 3 is a view from the top of the carrier of FIG. 1;

FIG. 4 is a perspective view of the carrier of FIG. 1 with a trash bag supported in one position;

Figure 6:
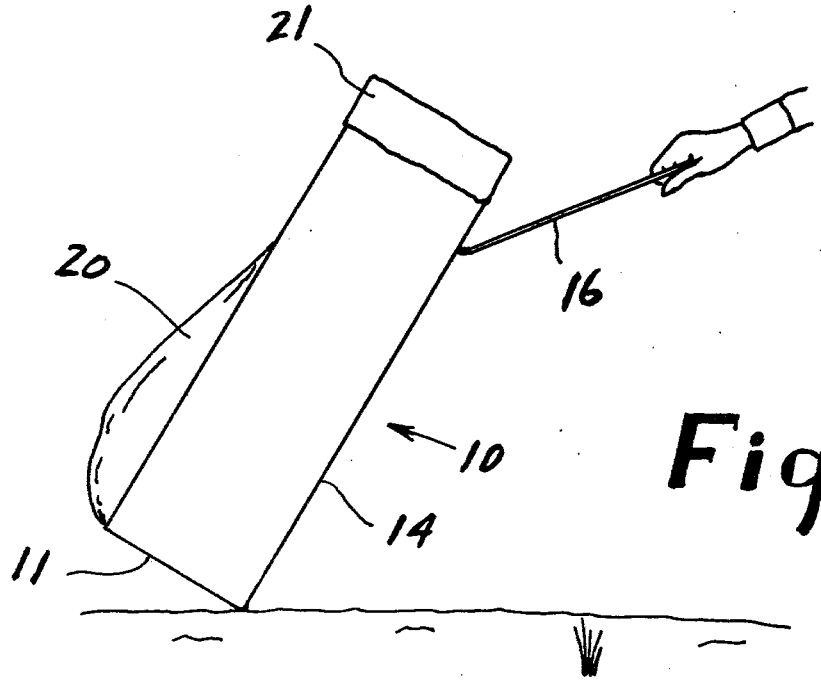
FIG. 6 is a view of the carrier of FIG. 1 with a trash bag being transported.

The above drawings illustrate one carrier of this invention. As shown in FIGS. 1–3, such a carrier can be a single piece of material formed in the shape of a hollow rectangular parallelepiped having a base 11, two side walls 12 and 13, and a back wall 14. The carrier is without those surfaces of a rectangular parallelepiped which would provide the top surface and front surface, as shown in FIGS. 1–3. This one piece carrier is formed from an elastic material, such as rigidized polyethylene, and its sides and base have a thickness of a fraction of an inch, such as 1/16 to ⅛ inch. The top edge 15 of the carrier (FIGS. 1 and 2) may thus be easily deformed elastically, for example, by bending sides 12 and 13 toward each other, and will recover its original shape. The sides and base have a uniform thickness, although the thickness can be varied to provide additional thickness where needed, as will be described. The dimensions of such a carrier are dependent on the size of the trash bag with which it is to be used. For use with a so-called thirty gallon trash bag, one such carrier can have a height of about 28 inches, a depth of about 8½ to 9 inches and a width of about 20½ inches, that is the back side 14 may be about 20½ by 28 inches, the base 11 about 20½ by 8½ to 9 inches and the sides 12 and 13 about 8½ to 9 by 28 inches.

These dimensions may, however, be varied to provide deeper side walls and a narrower back side, and the height of the carrier can be reduced.

Figure 5:
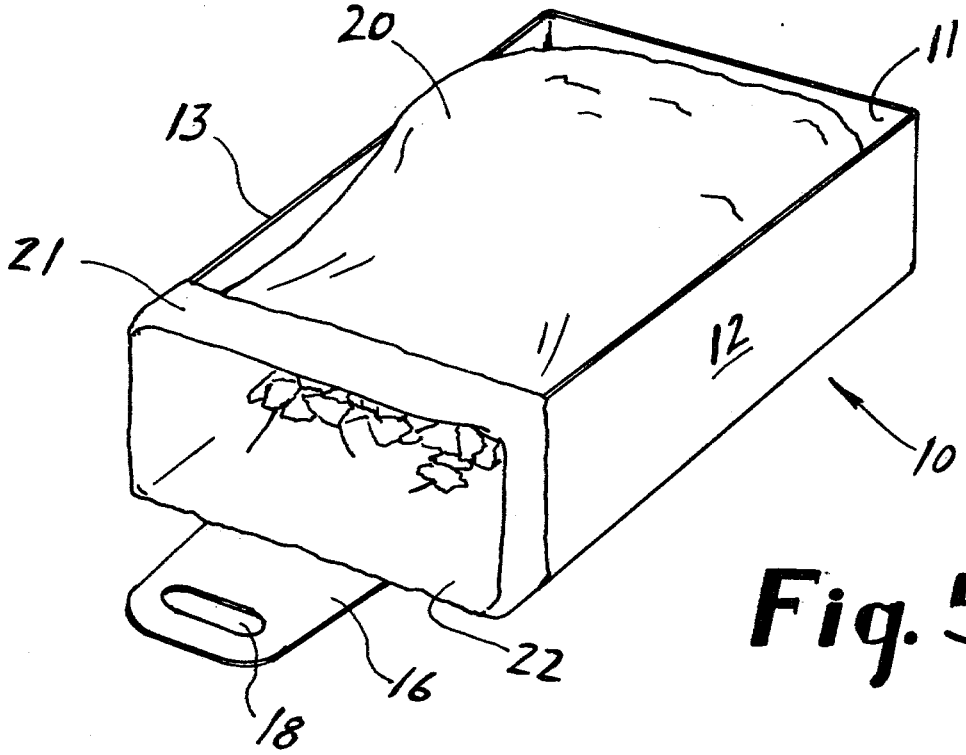
FIG. 5 is a perspective view of the carrier of FIG. 1 with a trash bag supported in another position.

As shown in FIG. 4, such a carrier will support a trash bag and its contents. The trash bag 20 is fitted to the carrier 10 by folding its mouth portion 21 over the top edge 15 of the carrier. To assist such fitting, the sides 12 and 13 of the carrier may be bent toward each other as the mouth portion 21 of the bag 20 is folded over the top 15 of the carrier. Upon release of sides 12 and 13 the mouth 22 of the bag 20 is held open. The top 15 of the carrier 10 may be flared slightly to assist in retaining the mouth portion 21 of the bag. So attached to the carrier 10, the bag 20 is supported as an open-mouthed container. As shown in FIG. 5, the carrier 10 and bag 20 may be positioned with the back 14 of the carrier on the ground to permit leaves and debris to be raked directly into the open mouth of the bag 20. In both positions shown in FIGS. 4 and 5, the bag 20 and its contents are supported by the carrier 10. The carrier 10 and bag 20 may be easily lifted from the position of FIG. 5 to the position of FIG. 4.

To assist in moving the carrier between positions and to assist in transportation of the carrier and bag between locations (as shown in FIG 6), the back 14 of the carrier may be provided with a flap 16 provided by cut 17. The flap is provided with an opening 18, adapted as a handle to be grasped by a user as shown in FIG. 6. The length of the flap 16 and the distance of termination of the cut 17 forming the flap from the top 15 of the carrier can be such that the carrier and bag can be easily pulled from one location to another, as shown in FIG. 6, without the user stooping. Such transportation eliminates lifting and carrying the filled trash bag.

Because many elastic materials from which the carrier may be constructed form lubricous surfaces, such carrier will slide relatively easily on the junction of the back side and base even carrying a filled trash bag. Lubricity of the surface will reduce the abrasion of the carrier in such use. Such sliding can be made even easier by providing the carrier with projecting portions 19 as shown, for example, in FIGS. 2, 3 and 6. The projections 19 reduce the contact between the carrier 10 and the ground and can protect the rear edge of the carrier 10 from abrasion in use.

Although the carrier 10 is shown with a uniform thickness, it may be made with portions of increased thickness. For example, the top 15 of the carrier 10 may be formed as a thickened edge to assist in retention of the mouth portion of the bag. The portion of the back 14 of the carrier at the ends of cut 17 may be thickened to resist the tearing of back 14 in the use of the handle 16. The edges of opening 18 may be thickened to provide a more comfortable handle for moving the carrier. The portions of the carrier, such as projection 19, if used on the edge between the back 14 and base 11, may be thickened to provide greater abrasion resistance. And thickened supporting and rigidizing portions may be provided in order to reduce or eliminate the material in the carrier. Carriers of this invention may be formed by compression molding.

Although the drawings show a carrier in the shape of a generally hollow rectangular parallelepiped without front and top surfaces, other generally hollow structures can be used to provide such a bag carrier, provided sufficient material is provided in the surrounding walls to hold the mouth of the trash bag open and to support the bag in its contents. The carrier can be formed have sides and a base with openings provided that sufficient material is present to partially surround and support the bag and to maintain them on the carrier. The specific material from which the carrier is made will determine, to a great extent, the amount of material in the carrier. Materials with greater strength and rigidity such as nylon and polypropylene may be used in lesser amounts to make such a carrier than materials such as polyethylene. With materials such as vulcanized rubber compounds, the quantity of material and its arrangement in the carrier depends upon the compound and its properties. When formed from such materials, the carrier can be left out-of-doors without fear of damage or deterioration due to the elements.

Such a carrier can be made in many designs and can include radii at corners and angular draft to facilitate manufacture by molding. Changes may be made in the construction and arrangement without departing from the scope of the invention as set forth in the following claims.

I claim:

1. A carrier for a trash bag, comprising; a one-piece structure formed from elastic material and with a generally hollow three sided shape without front and top surfaces to permit insertion of the trash bag and with sufficient material forming a base and side walls with a top edge to engage the opening of the trash bag by deformation of the structure and to hold the trash bag open by elastic recovery and to support the trash bag and its contents with the trash bag opening unobstructed, the side wall opposite the open front of the structure including a flap cut therein and remaining attached to the side wall at its upper portion, said flap having an opening adjacent its free end to be grasped as a handle with the length of the flap between the opening and the unattached portion being sufficient that the carrier can be pulled by the flap generally without stooping.

2. The carrier of claim 1 wherein the upper edge of the carrier is formed with an outward projection to assist engagement of the bag opening, and the base of the structure and its side walls include projections to serve as runners.

3. A carrier for a trash bag, comprising; means forming a generally hollow one piece structure with an elastic top edge adapted to be deformed for engagement with the opening of a trash bag and upon elastic recovery to engage and form the opening of the trash bag into an unobstructed opening and with only sufficient wall surface extending from a base to partially surround and support the bag and its contents in an upright position and on its back as an open-mouthed container, said means including a handle connected with the structure, said handle and structure providing sufficient height in use that the trash bag and its contents can be transported by pulling said means substantially without stooping.

4. The carrier of claim 3 wherein said means is molded in one piece from a moldable material that forms an elastic solid when cured.

5. The carrier of claim 4 wherein said means is molded from a single sheet of plastic material.

6. The carrier of claim 3 wherein the structure is generally in the shape of a hollow rectangular parallelepiped without a front or a top surface and with a flap cut into the surface forming the back, said flap having an opening adjacent its unattached end to be grasped as a handle and remaining attached to the structure at the end opposite the unattached end, thereby permitting the carrier to be pulled like a sled.

7. A mobile carrier for a trash bag, comprising; a generally three-sided structure with a base forming a generally hollow shape without front and top surfaces permitting insertion and removal of a trash bag from the front and with sufficient material forming the base and side walls and a top edge to permit the mouth of the trash bag to be folded over the top edge of the structure and to hold the end of the trash bag open and to support the trash bag and its contents in at least two positions with its opening unobstructed, said structure further providing grip means to permit the trash bag and its contents to be transported.

8. The mobile carrier of claim 7 wherein the side walls form a back to the structure and provide said grip means including a flap cut therein and remaining attached to the back at its upper portion, said flap having a opening adjacent its free end to be grasped as a handle with the length of the flap between the opening and the uncut portion of the back being sufficient that the carrier can be pulled by the flap generally without stooping.

9. The mobile carrier of claim 8 wherein the edge between the base of the structure and its back includes projecting portions to serve as runners.

10. A carrier for a trash bag, comprising; a one-piece structure forming an elastic top edge adapted to be deformed for engagement with the opening of a trash bag of about thirty gallons capacity and upon elastic recovery to engage and form the opening of the trash bag into an unobstructed opening and further forming a base and side wall surfaces to partially surround and hold the bag in the form of an open-mouthed container and to support the bag and its contents in several positions and a handle to permit movement of the trash bag with the structure.

11. The carrier of claim 10 wherein said structure is molded from a material forming an elastic solid when cured.

12. The carrier of claim 10 wherein said structure is formed from a single sheet of elastic material.

13. A carrier for a trash bag, comprising; a structure formed of elastic material with a generally hollow rectangular parallelopiped shape without front and top surfaces to permit insertion and removal of the trash bag through the front without lifting and with sufficient material forming a base, a back and side walls and a top edge to engage the opening of the trash bag by deformation of the structure and to hold the trash bag open by elastic recovery and to support the trash bag and its contents with its opening unobstructed when the structure sets on either its base or its back, said back providing handle means to permit the carrier to be gripped and the trash bag and its contents to be transported by the structure.

14. The carrier of claim 13 wherein the back includes a flap cut therein and remaining attached thereto, said flap having an opening adjacent its free end to be grasped as a handle with the length of the flap between the opening and the uncut portion of the back being of sufficient length that the carrier can be pulled by the flap without stooping.

15. A carrier for a trash bag, comprising; means forming a generally hollow structure with an edge to engage and form the mouth of the trash bag into an unobstructed opening in several positions, said means further forming only a base and side wall surfaces extending from the base to said edge and providing another supporting surface in at least one other position and partially surrounding and supporting the bag and its contents in the several positions while permitting the trash bag and its contents to be removed from the front of the means without lifting, and said means further providing a grip for movement of the trash bag and its contents.

16. A mobile carrier for a trash bag, comprising; a generally three-sided structure with a base forming a generally hollow shape without front and top surfaces permitting insertion and removal of a trash bag from the front without lifting and with sufficient material forming the base and side walls and a top edge to permit the mouth of the trash bag to be folded over the top edge of the structure and to be held thereby open and to support the trash bag and its contents in at least two positions with its opening unobstructed, said structure further providing projecting portions between its base and side walls to serve as runners and a handle at sufficient height to permit the trash bag and its contents to be transported.

* * * * *